US006264314B1

(12) United States Patent
Mochizuki et al.

(10) Patent No.: US 6,264,314 B1
(45) Date of Patent: Jul. 24, 2001

(54) INK CARTRIDGE FOR INK JET RECORDING APPARATUS

(75) Inventors: Seiji Mochizuki; Kazuhisa Kawakami; Masahiro Isono; Yukihiro Hanaoka; Atsushi Nishioka, all of Nagano (JP)

(73) Assignee: Seiko Epson Corporation, Tokyo (JP)

( * ) Notice: Subject to any disclaimer, the term of this patent is extended or adjusted under 35 U.S.C. 154(b) by 590 days.

(21) Appl. No.: 08/925,387

(22) Filed: Sep. 8, 1997

Related U.S. Application Data

(63) Continuation-in-part of application No. 08/295,040, filed on Aug. 25, 1994, now Pat. No. 5,666,146, which is a continuation of application No. 07/888,369, filed on May 26, 1992, now abandoned.

(30) Foreign Application Priority Data

| | | |
|---|---|---|
| May 27, 1991 | (JP) | 3-121136 |
| Jul. 8, 1991 | (JP) | 3-166854 |
| Jul. 8, 1991 | (JP) | 3-166855 |
| Jul. 8, 1991 | (JP) | 3-166856 |

(51) Int. Cl.[7] ..... B41J 2/175
(52) U.S. Cl. ..... 347/86
(58) Field of Search ..... 347/84, 85, 86, 347/87

(56) References Cited

U.S. PATENT DOCUMENTS

| | | | |
|---|---|---|---|
| 3,913,774 | 10/1975 | Vajtay . | |
| 4,303,929 | 12/1981 | Blanck | 347/86 |
| 4,335,950 | 6/1982 | Gunzelmann et al. | 271/273 |
| 4,551,734 | 11/1985 | Causley et al. | 317/86 |
| 4,577,203 | 3/1986 | Kawamura | 347/86 |
| 4,928,126 | 5/1990 | Asai | 347/86 |
| 4,974,977 | 12/1990 | Morgan et al. | 400/208 |
| 5,307,091 | 4/1994 | DeCoste, Jr. | 347/86 |
| 5,666,146 * | 9/1997 | Mochizuki et al. | 347/86 |

FOREIGN PATENT DOCUMENTS

| | | |
|---|---|---|
| 59212272 | 12/1984 | (EP) . |
| 2192591 | 1/1988 | (EP) . |
| 0364284 | 4/1990 | (EP) . |
| 364284 | 4/1990 | (EP) . |

(List continued on next page.)

OTHER PUBLICATIONS

Patent Abstracts of Japan, vol. 9, No. 57 (M–363), Mar. 1985.

Japanese Office Action dated Oct. 5, 1999 with an English translation.

*Primary Examiner*—N. Le
*Assistant Examiner*—Michael Nghiem
(74) *Attorney, Agent, or Firm*—Sughrue, Mion, Zinn, Macpeak & Seas, PLLC

(57) ABSTRACT

An ink cartridge employable for an ink jet type recording apparatus includes a case (4) having a front plate (4*a*) with at least one position determining hole (4*h*/4*g*) formed therein. An ink bag (1) containing a supply of ink is received in the case (4) in a manner such that the position determining hole (4*h*/4*g*) allows the insertion of a position determining shaft (16/17) projecting from an inner end of a cartridge holder (90) through the position determining hole (4*h*/4*g*) to guide and properly locate the ink cartridge (80) relative to the cartridge holder (90) without establishing communication between the ink bag (1) and the position determining shaft (16/17). An ink outlet piece (2) having an ink flow path therein communicates with the ink bag (1) so that an ink feeding needle (15) disposed at the inner end of the cartridge holder (90) and slightly behind the position determining shaft (16/17) is capable of piercing through the ink outlet piece (2) to reach an interior of the ink bag (1), the outlet piece (2) being positioned to contact the ink feeding needle (15) after the ink cartridge (80) has been properly located relative to the cartridge holder (90) by the position determining hole (4*h*, 4*g*) and the position determining shaft (16/17).

7 Claims, 11 Drawing Sheets

FOREIGN PATENT DOCUMENTS

| | | |
|---|---|---|
| 380199 | 8/1990 | (EP) . |
| 440261 | 8/1991 | (EP) . |
| 248599 | 7/1981 | (FR) . |
| 2485991 | 1/1982 | (FR) . |
| 58-211482 | 12/1983 | (JP) . |
| 59-227458 | 12/1984 | (JP) . |
| 60-125671 | 7/1985 | (JP) . |
| 61-141248 | 9/1986 | (JP) . |
| 61-230939 | 10/1986 | (JP) . |
| 62-60334 | 4/1987 | (JP) . |
| 62-60335 | 4/1987 | (JP) . |
| 63-4953 | 1/1988 | (JP) . |
| 63-296956 | 12/1988 | (JP) . |
| 1141749 | 6/1989 | (JP) . |
| 1-99633 | 7/1989 | (JP) . |
| 1180351 | 7/1989 | (JP) . |
| 2-28473 | 2/1990 | (JP) . |
| 2-108551 | 4/1990 | (JP) . |
| 2187349 | 7/1990 | (JP) . |
| 2192953 | 7/1990 | (JP) . |
| 2-243351 | 9/1990 | (JP) . |
| 3-7350 | 1/1991 | (JP) . |

* cited by examiner

INK CARTRIDGE FOR INK JET RECORDING APPARATUS

This is a Continuation-in-Part of parent application Ser. No. 08/295,040 now U.S. Pat. No. 5,666,146 filed Aug. 25, 1994, which is a Continuation Application of grandparent application Ser. No. 07/888,369 filed May 26, 1992 abandoned. The parent application Ser. No. 08/295,040 filed Aug. 24, 1995 is incorporated herein by reference.

BACKGROUND OF THE INVENTION

The present invention relates to an ink cartridge for use with an ink jet recording apparatus that performs a recording operation by jetting a series of ink droplets onto a recording paper through a nozzle.

Various kinds of ink feeding systems for an ink jet recording apparatus of the aforementioned type have been hitherto proposed and put to practical use.

To facilitate understanding of the present invention, a conventional ink cartridge having a flexible ink bag received therein and a mechanism for installing the ink cartridge will briefly be described below with reference to FIG. 7 and FIG. 8.

The ink cartridge includes an ink bag a, and a tubular ink outlet piece b is integrated with the ink bag a by applying thermal fusion on one of the thermally fused sides (represented by hatched lines), thereby to allow ink in the ink bag a to be conducted to the outside through the ink outlet piece b. To fixedly hold the ink bag a at a predetermined position in a case e, the ink outlet piece b is provided with a pair of flanges c through which holes d are formed. Thus, the ink bag a can be positioned and fixedly received in the case e by fitting a pair of projections f on the front end part of the case e into the holes d. In addition, the ink cartridge includes a cover j which is placed on the opening of the case e. The cover j is integrated with the case e by thermally sealing the peripheral edge of the case e using an ultrasonic welding process.

A holder m having the case e received therein is fixedly mounted on an ink jet recording apparatus (not shown). The holder m includes a pair of frames n on the opposite sides thereof so as to guide slidable insertion of the ink cartridge h composed of the ink bag a and the case e. In addition, the holder m includes a pair of leaf springs p at the innermost end of the frame n. When ribs i on the opposite side walls of the ink cartridge h are engaged with the leaf springs p, the ribs i are fixedly retained by the leaf springs p. At this time, an ink feeding needle g projection from the ink jet recording apparatus is ready to pierce the central part of the ink outlet piece b.

With such construction, the positional relationship between the ink feeding needle g and the opposing pair of frames n, the positional relationship between the leaf springs p and the ribs i and the positional relationship between the case e and the ink outlet piece b are liable to be undesirably disturbed during steps of fitting and assembling. Thus, there is left unsolved a problem that the ink feeding needle g sometimes cannot be correctly located in alignment with the ink outlet piece b.

In addition, if the cover j is removed from the case e, it is difficult as a practical matter to reunite the former with the latter again such as by employing a thermal fusion process. For this reason, the ink cartridge h cannot repeatedly be used. Further, since the ink outlet piece b is secured to the thermally fused surfaces of the ink bag a, there is left unsolved another problem that a certain gap appears between the ink outlet piece b and the thermally fused surfaces.

SUMMARY OF THE INVENTION

Accordingly, an object of the present invention is to provide an ink cartridge for an ink jet recording apparatus wherein an ink outlet piece can be correctly aligned with an ink feeding needle regardless of a slight positional deviation from their preferred positions.

Another object of the present invention is to provide an ink cartridge for an ink jet recording apparatus wherein a case and a cover placed on the opening of the case can repeatedly be used.

According to one embodiment of the present invention, there is provided an ink cartridge assembly for an ink jet recording apparatus wherein the ink cartridge includes a fitting portion formed on a front plate of a case constituting the ink cartridge, the fitting portion serving to hold and locate an ink outlet piece in an engaged state by engaging the fitting portion with an engaging portion on the ink outlet piece and at least one position determining hole formed on the front plate of the case, the position determining hole serving to properly locate the ink cartridge relative to a cartridge holder by inserting a position determining shaft projecting from the inner end of the cartridge holder through the position determining hole. With such construction, the ink feeding needle can be correctly located in alignment with the ink outlet piece with the front plate of the case serving as a reference.

To assure that the case and the cover can repeatedly be used, engagement holes are formed on the front plate of the case positioned so as to engage with the corresponding corner portions disposed on the front edge of a cover, and engagement portions are formed on the opposite side plates of the case at the rear end of the same positioned so as to engage with the corresponding pawls disposed on the opposite sides of the cover at the rear end of the same, whereby the cover can be repeatedly fitted to the case in a snap fit fashion.

According to another embodiment of the present invention, there is provided an ink cartridge for an ink jet recording apparatus which also includes an absorbing member, disposed to be stacked with the ink bag in the case, for absorbing exhaust ink within the ink cartridge. There is also provided an exhaust ink take-in piece for supplying the exhaust ink to the inner end of the cartridge holder.

Other objects, features and advantages of the present invention will become apparent from reading of the following description which has been made in conjunction with the accompanying drawings.

DESCRIPTION OF THE PREFERRED EMBODIMENTS

The present invention will hereinafter be described in detail with reference to the accompanying drawings, which illustrate preferred embodiments of the present invention.

Figure 1:
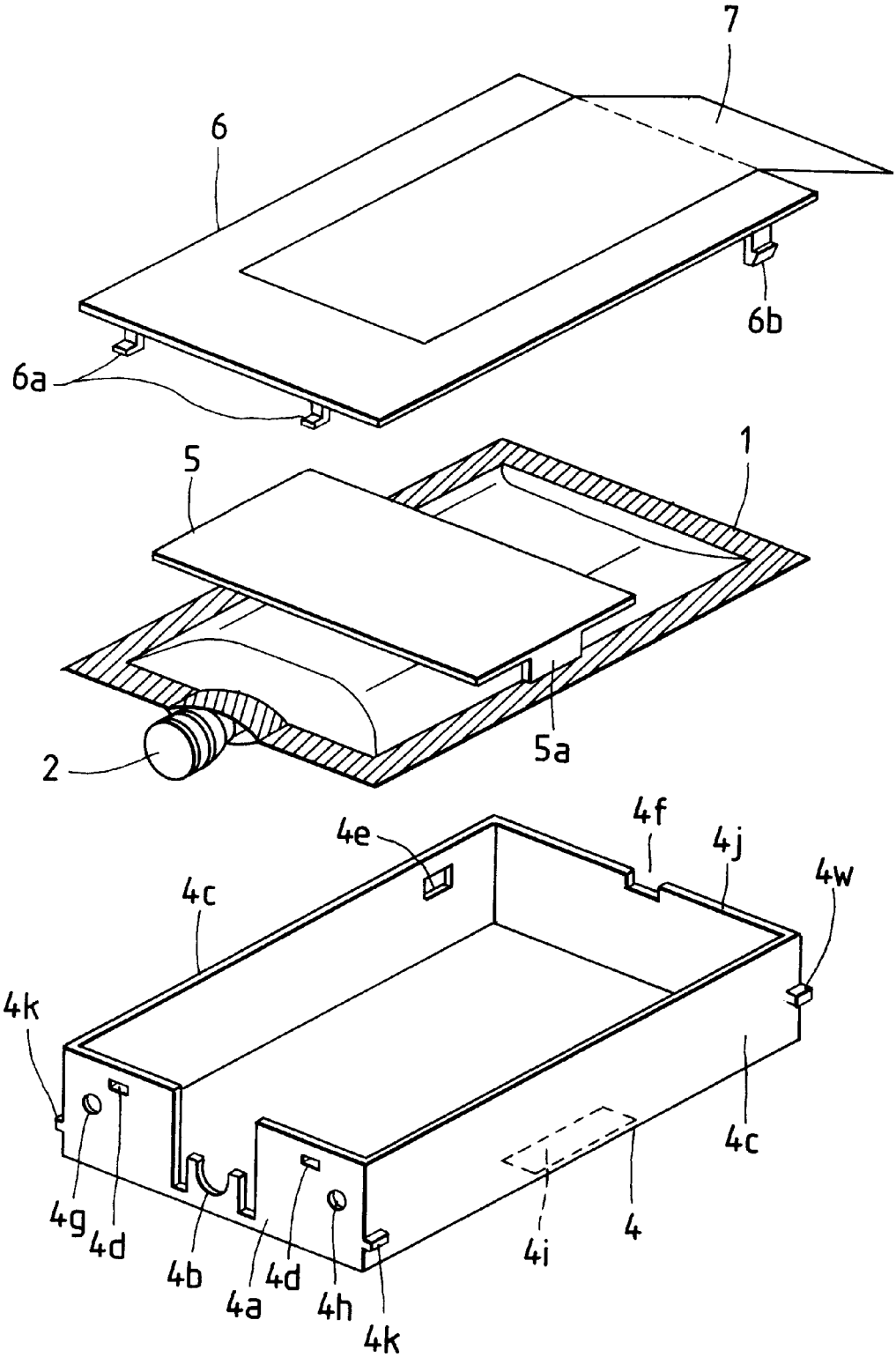
FIG. 1 is a perspective view of a preferred embodiment of an ink cartridge for an ink jet type recording apparatus constructed in accordance with the present invention, particularly illustrating the structure of the ink cartridge in a disassembled state.
Figure 2:
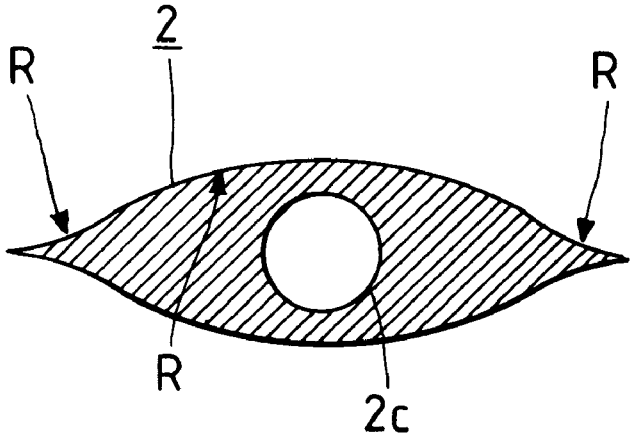
FIG. 2 is a cross-sectional view of an ink outlet piece to be secured to an ink bag.
Figure 3:
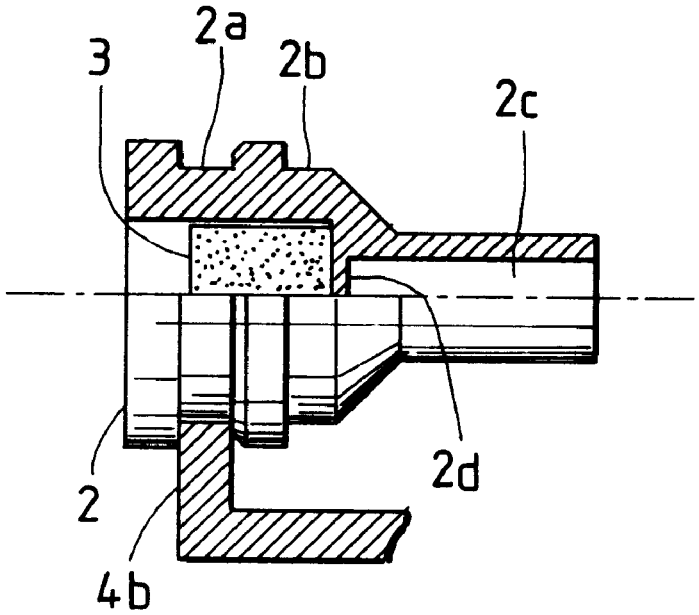
FIG. 3 is a sectional view of a position determining/engaging mechanism for the ink outlet piece.

FIG. 1 is a perspective view which illustrates an ink cartridge for an ink jet recording apparatus and which is constructed in accordance with a preferred embodiment of the present invention, FIG. 2 is a cross-sectional view of an ink outlet piece to be fitted to an ink bag, and FIG. 3 is a partially sectioned view of a position determining/engaging mechanism for the ink outlet piece.

The ink bag designated by reference numeral 1 is constructed using a laminated aluminum film which is laminated with two films such that the outside of the ink bag is lined with, e.g., a nylon film, while the inside of the same is lined with, e.g., a polyethylene film in order to improve the gas barrier property of the ink bag. These films are thermally fused together along the outer peripheral edge of the ink bag 1.

To conduct ink out of the ink bag 1 to the outside, an ink outlet piece 2 is integrated with the ink bag 1 by thermal fusion on the front side, as seen in FIG. 1. The ink outlet piece 2 is molded of a plastic material. As shown in FIG. 2, the rear part of the ink outlet piece 2, i.e., the joint location where the ink bag 1 is thermally fused with the ink outlet piece 2, is constructed in a leaf-shaped configuration such that the central part exhibits an convex arc having a large radius of curvature and the opposite ends exhibit an concave arc having a large radius of curvature. With this construction, a gap between the ink bag 1 and the ink outlet piece 2 is fully filled with molten material during a thermal fusing operation to provide a reliable seal.

The forward half of the ink outlet piece 2 has a circular sectional shape, and an annular engagement groove 2*a* for holding the ink bag 1 at a predetermined position on a case 4 (similar to the position determining annular engagement groove 2 disclosed in commonly assigned Japanese Examined Patent Application Publication (Kokoku) No. 2-192953) is formed around the outer periphery of the ink outlet piece 2. A fitting portion 4*b* of the case 4 is fitted into the engagement groove 2*a* (see FIG. 3). In addition, a chuck portion 2*b* is formed around the central part of the ink outlet piece 2 so as to facilitate grasping of the ink bag 1 during a step of automatically receiving the ink bag 1 in the case 4 on a mass production line. A tube portion 2*c* is formed along the center axis of the ink outlet piece 2 so as to conduct ink from the ink bag 1 to the outside. A sealing member 3 molded of an elastic material such rubber or the like is fitted into the forward end part of the ink outlet piece 2 so as to reliably maintain airtightness between the member 3 and an ink feeding needle 15 (to be described later). Further, a film portion 2*d* is interposed between the tube portion 2*c* and the sealing member 3 in order to prevent incorrect printing from being performed due to undesirable elution or deposition of the rubber caused by direct contact of the ink with the sealing member 3.

Figure 4:
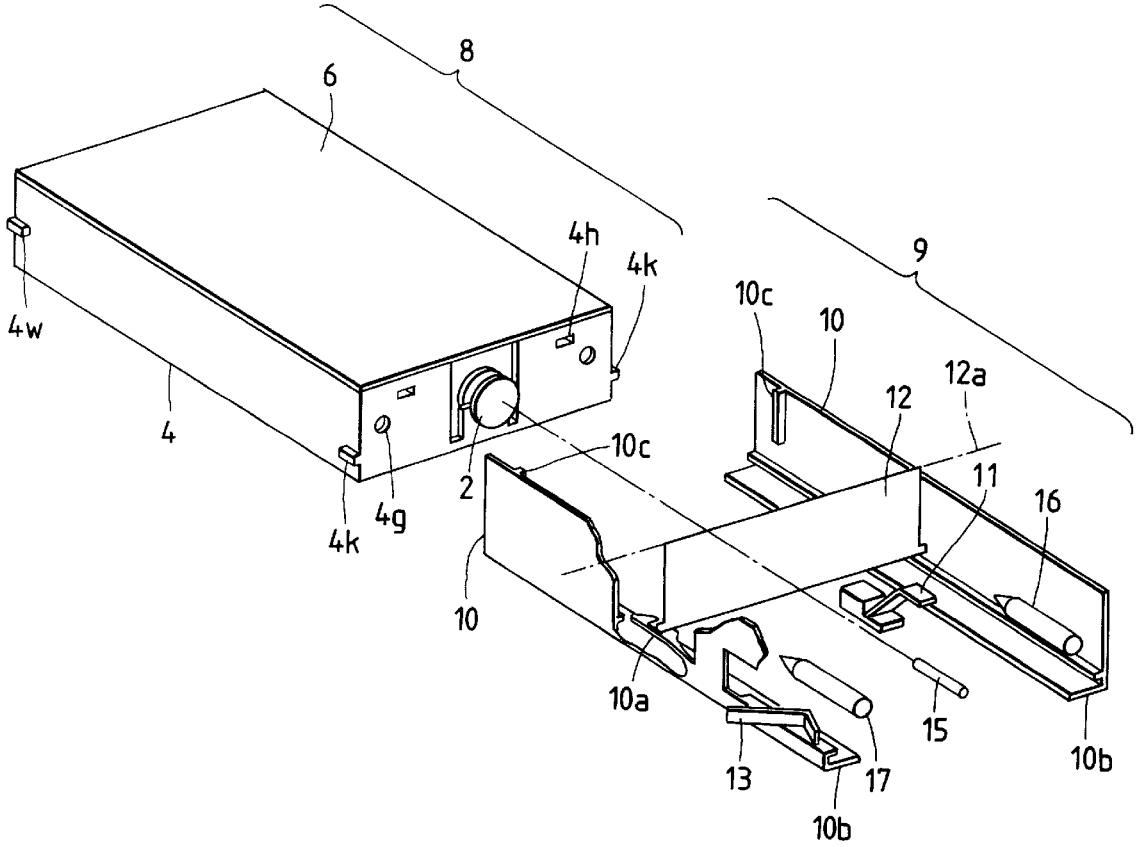
FIG. 4 is a perspective view of the ink cartridge and a holder, particularly illustrating the structure of the holder in a disassembled state.

The case 4 for receiving the ink bag 1 is designed in a box-shaped configuration having a small thickness. A fitting portion 4*b* having a semicircular recess to be engaged with the engagement groove 2*a* of the ink outlet piece 2 is formed on a front plate 4*a* of the case 4 in a snap-fit fashion. In addition, an opposing pair of position determining holes 4*g* and 4*h* are formed on the front plate 4*a* of the case 4 with the fitting portion located therebetween. As shown in FIG. 4, the case 4 is correctly held at a predetermined position as seen not only in the upward/downward direction but also in the leftward/rightward direction by inserting a position determining shaft 16 and a guide shaft 17 on a holder 9 into the position determining holes 4*g* and 4*h*.

Figure 6C:
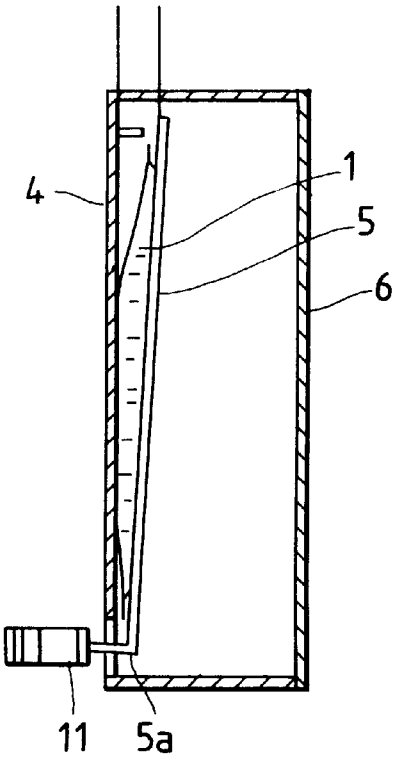
FIGS. 6*a*–6*c* are sectional views of the ink cartridge, particularly illustrating displacement of a detection plate in the ink cartridge.
Figure 6B:
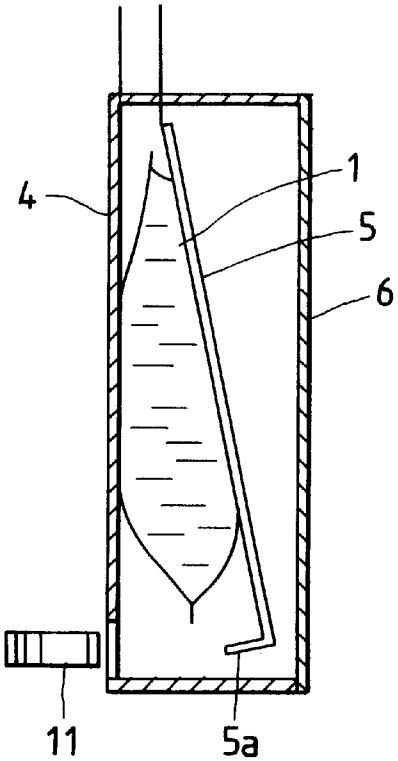
Figure 6A:
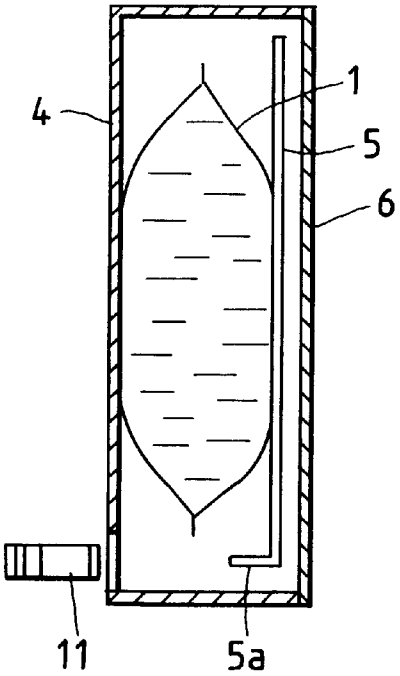
Figure 7:
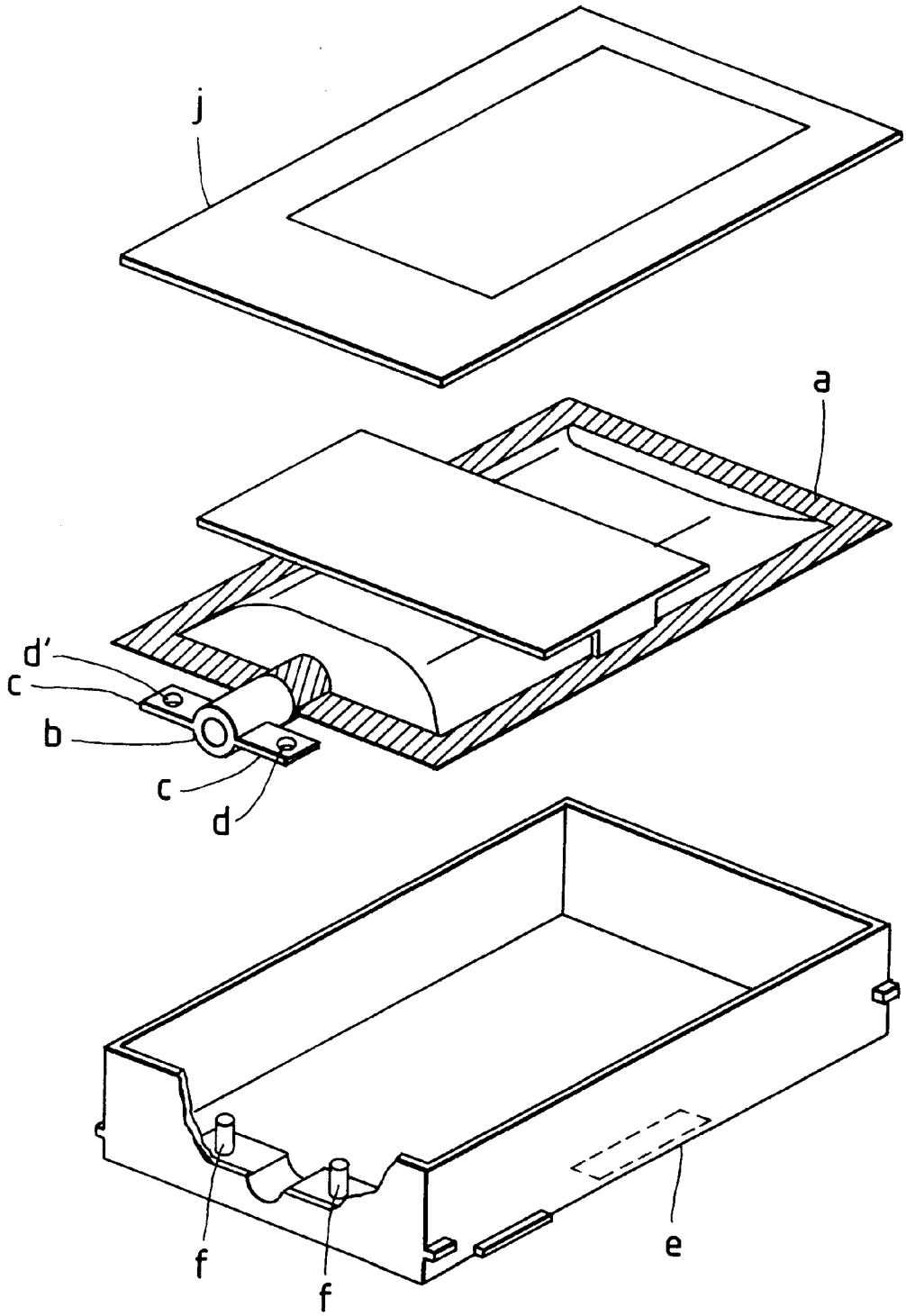
FIG. 7 PRIOR ART
FIG. 7 is a perspective view of a conventional ink cartridge, particularly illustrating the structure of the ink cartridge in a disassembled state.
Figure 8:
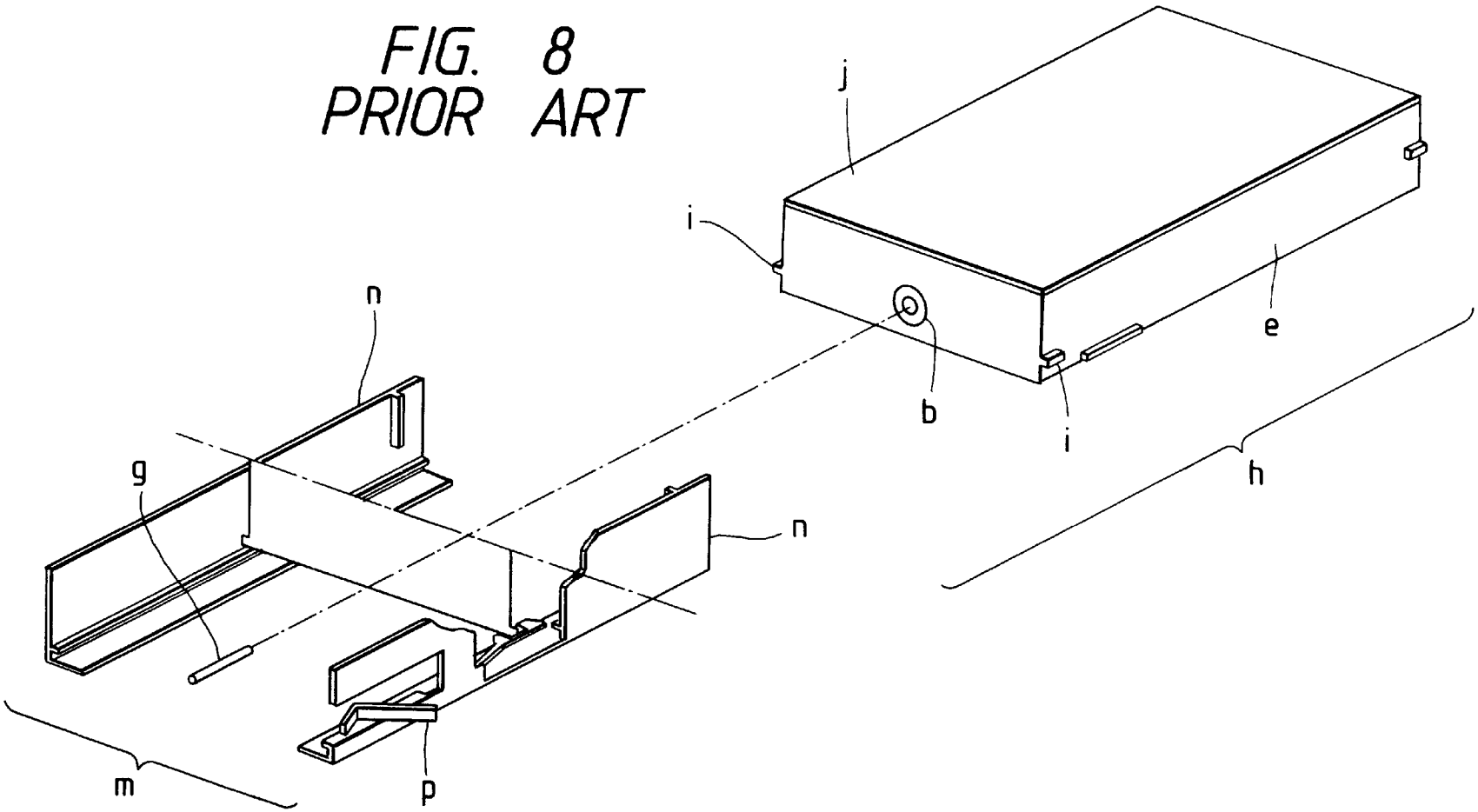
FIG. 8 PRIOR ART
FIG. 8 is a perspective view of the ink cartridge and a holder, particularly illustrating the structure of the holder.

The ink bag 1 is firmly held in position in the case with the aid of a pressure-sensitive-adhesive double-sided tape (hereinafter referred to simply as an adhesive tape), and a detection plate 5, of which the forward end is bent at a right angle, is adhesively attached to the upper surface of the ink bag 1 with the aid of an adhesive tape. As the quantity of the ink in the ink bag 1 decreases, the bent part 5*a* of the detection plate 5 is projected outside of a rectangular hole 4*i* at the lower part of the case 4, whereby a so-called "near-end" state of the ink can be detected by an ink end detector 11, as shown in FIG. 6.

A cover 6 placed on the opening portion of the case 4 includes a pair of corner portions 6*a* along the front edge thereof, and a pair of pawls 6*b* on the opposite sides at the rear end thereof. Thus, the cover 6 can be firmly fitted to the case 4 in a snap-fit fashion by inserting the corner portions 6*a* into holes 4*d* on the front plate 4 of the case 4 and then fitting the pawls 6*b* into recesses 4*e* on side plates 4*c* of the case 4 at the rear part of the same. When the cover 6 is to be removed from the case 4, it is recommended to insert a jig or other tool into a cutout 4*f* on a rear plate 4*j* of the case 4 and then pry off the cover 6.

A label 7 having a caution instruction or the like printed thereon is adhesively arranged on the cover 6 in such a manner as to hide the cutout 4*f* from the outside. This arrangement prevents not only dislodgment of the cover 6 from the case 4 due to vibration or careless dropping, but also intentional opening of the cover 6.

According to a modified embodiment of the present invention, an ink cartridge may be constructed such that the corner portions 6*a* and the pawls 6*b* on the cover 6 are eliminated and the cover 6 is firmly held merely by the label 7. In this embodiment, it is necessary that the label 7 be adhesively placed on the case 4 while extending from the front plate 4*a* to the rear plate 4*j* of the case 4. With this construction, the ink cartridge can be provided at a more inexpensive cost.

Next, a mechanism for installing an ink cartridge 8 in an ink jet recording apparatus will be described below with reference to FIG. 4.

A holder 9 is fixedly mounted on the ink jet recording apparatus I (not shown). To assure that the ink cartridge 8 is correctly received in the holder 9 and then firmly held at a predetermined position on the holder 9, an opposing pair of frames 10 are arranged for constructing the holder 9. In addition, a shutter 12 is arranged so as to prevent the ink feeding needle 15 projecting into the interior of the holder 9 to touch the user's hand when the ink cartridge is received in the holder 9. The shutter 12 is turnably supported on the holder 9 to turn about a rotational center axis 12*a* so that it normally assumes the position shown by the action of a shutter spring (not shown). While the shutter is in the position shown, it is engaged with pawls of elastically deformable lock arms 10*a* disposed along the lower edges of the frames 10.

The forwardmost end of each of the lock arms 10*a* normally projects into a guide groove 10*b* extending along the lower edge of the frame 10. Thus, when the ink cartridge 8 is inserted midway between both the frames 10, the lock arms 10*a* are squeezed by ribs 4*k* on the opposite sides of the cast 4 at the forwardmost end of the same so that they are displaced from the engaged state.

Leaf springs 13 arranged at the innermost ends of the opposing pair of frames 10 project into the region where the ink cartridge 8 is to be received. When the ink cartridge 8 is inserted and reaches the innermost end of the holder 9 while being guided by a position determining shaft 16 and a guide shaft 17, the leaf springs 13 engage with the ribs 4*k* on the case 4, whereby the ink cartridge 8 is firmly held in place.

As is best seen in FIG. 4, the ink feeding needle 15 disposed at the innermost end of the cartridge 9 projects toward the ink cartridge 8 at the position where it is located slightly behind the position determining shaft 16 and the guide pin 17. Thus, when the ink cartridge 8 is firmly retained by the leaf spring 13, the ink feeding needle 15 pierces through the sealing member 3 and the ink outlet piece 2 to reach the interior of the ink bag 1.

In FIG. 4, reference numeral 4*w* designates ribs which are formed on the opposite side of the case 4 at the rearmost end of the same so as to prevent erroneous insertion of the ink cartridge 8. If the ink cartridge 8 is inserted in the reverse direction by mistake, the ribs 4*w* collide with erroneous insertion preventing projections 10*c* on the frames 10, making it impossible for the ink cartridge 8 to be inserted into the holder 8 any further.

Figure 5:
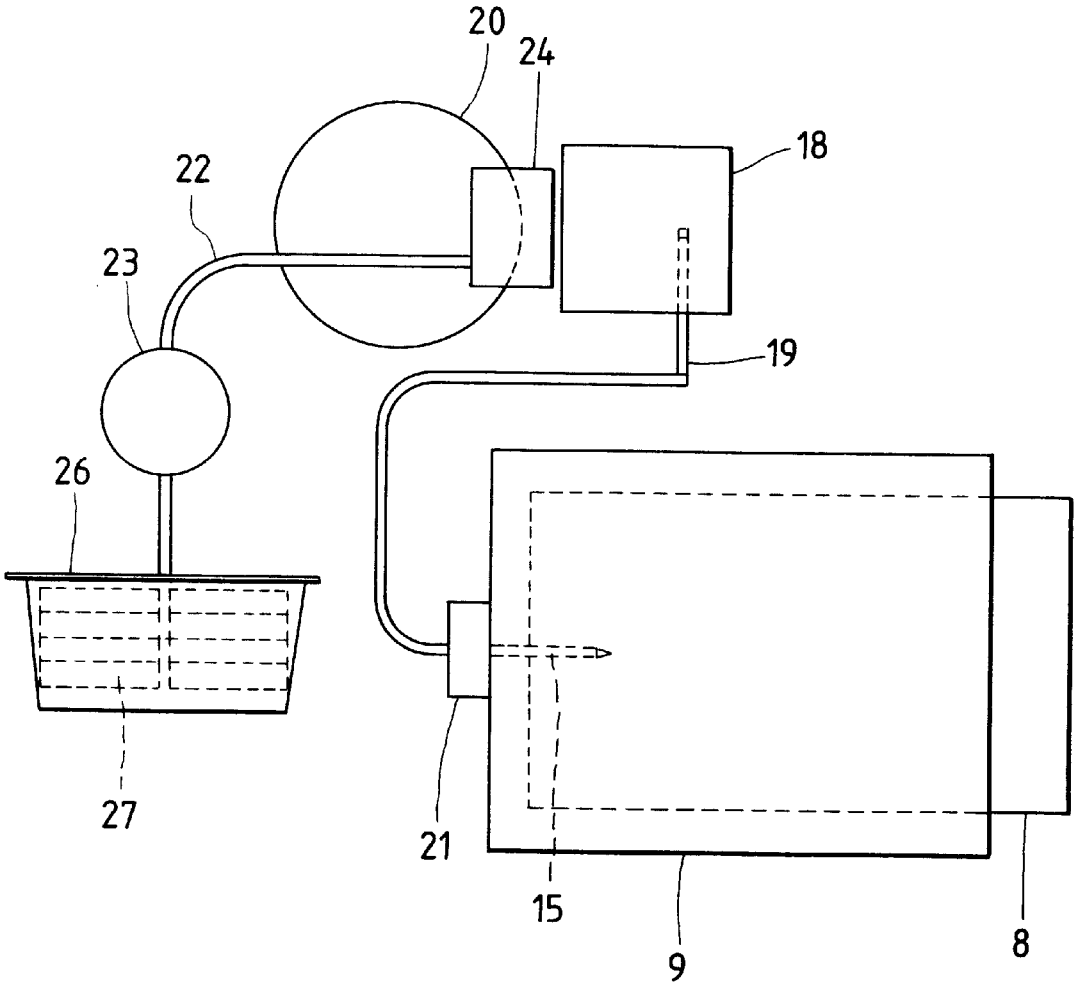
FIG. 5 is a diagrammatic view schematically illustrating an ink flow passage system for the ink jet recording apparatus.

FIG. 5 is a diagrammatic view which illustrates an ink flow passage system for the ink jet recording apparatus.

As shown in the drawing, a filter 21 is arranged on the left-hand end surface of the holder 9 for preventing dust or other foreign material from entering the ink flow passage system. The ink feeding needle 15 is connected to a printing head 18 via the filter 21 and an ink feeding tube 19.

In FIG. 5, reference numeral 24 designates a cap disposed outside of a non-printing region. The cap 24 communicates with a waste liquid bag 26 via a waste liquid tube 22 and a pump 23. When a printing head 18 returns to a waiting position, the cap 24 comes into contact with the nozzle surface of the printing head 18 so that ink remaining in the printing head 18 is recovered in a waste liquid absorbing material 27 in the waste liquid bag 26 so as to prevent the printing head 18 from being clogged with used ink when the ink jet recording apparatus is held in an inoperative state.

Next, the installation of the ink cartridge 8 constructed in the above-mentioned manner will be described below.

The ink outlet piece 2, the rear half of which has a leaf-shaped cross-sectional contour, can be secured to the upper and lower films of the ink bag 1 by thermal fusion not only without any gap therebetween but also without large warpage thereof.

When the ink bag 1 is received in the case 4, the forward half of the ink outlet piece 2 projecting outside of the ink bag 1 is located in alignment with the front plate 4*a* of the case 4 so as to allow the engagement groove 2*a* of the ink outlet piece 2 to be engaged with the fitting portion 4*b* at the central part of the front plate 4*a*. Thus, the ink bag 1 is located and received at a predetermined position on the case 4 while the front plate 4*a* of the case 4 serves as a reference.

Next, the detection plate 5 is adhesively placed on the upper surface of the ink-bag 1 using adhesive tape, and thereafter the cover 6 is placed on the case 4. At this time, while the corner portions 6*a* on the front edge of the plate 4*a* of the case 4, the rear end part of the cover 6 is depressed with an user's hand, causing the pawls 6*b* on the opposite sides of the case 4 at the rear end of the same to be engaged with the recesses 4*e* on the side plates 4*c* of the case 4. Consequently, the cover 6 is firmly fitted into the opening of the case 4 in the snap-fit fashion.

When the ink cartridge 8 assembled in the above-described manner is received in the holder 9, the ink cartridge 8 having the ink outlet piece 2 located ahead thereof is inserted into the holder 9 by sliding the same along the guide grooves 10*b* of the frames 10. As the ribs 4*k* are slidably displaced in this manner, first they deflect the lock arms 10*a* in the outward direction so as to allow the shutter 12 to be released from the engaged state. Then, the ink cartridge 8 turns the shutter in the upward direction, whereby it is introduced into the holder 9.

When the ink cartridge 8 is inserted to a position in the vicinity of the innermost end of the holder 9, the position determining shaft 16 and the guide shaft 17 horizontally projecting toward the front plate 4*a* of the case 4 are inserted through the corresponding holes 4*g* and 4*h* on the front plate 4*a* of the case 4 so that the ink cartridge 8 is correctly received in the holder 9 not only in the upward/downward direction but also in the leftward/rightward direction.

Subsequently, when the ink cartridge 8 is squeezed further to contact the innermost end of the holder 9 with the aid of the position determining shaft 16 and the guide shaft 17, the ink feeding needle 15 projecting from the innermost end of the holder 9 pierces the sealing member 3 and the film portion 2*d* so as to be inserted into the ink bag 1. At this point, the ink contained in the ink bag 1 is ready for use.

Another embodiment of the invention will be described with reference to FIGS. 9 through 12.

Figure 12:
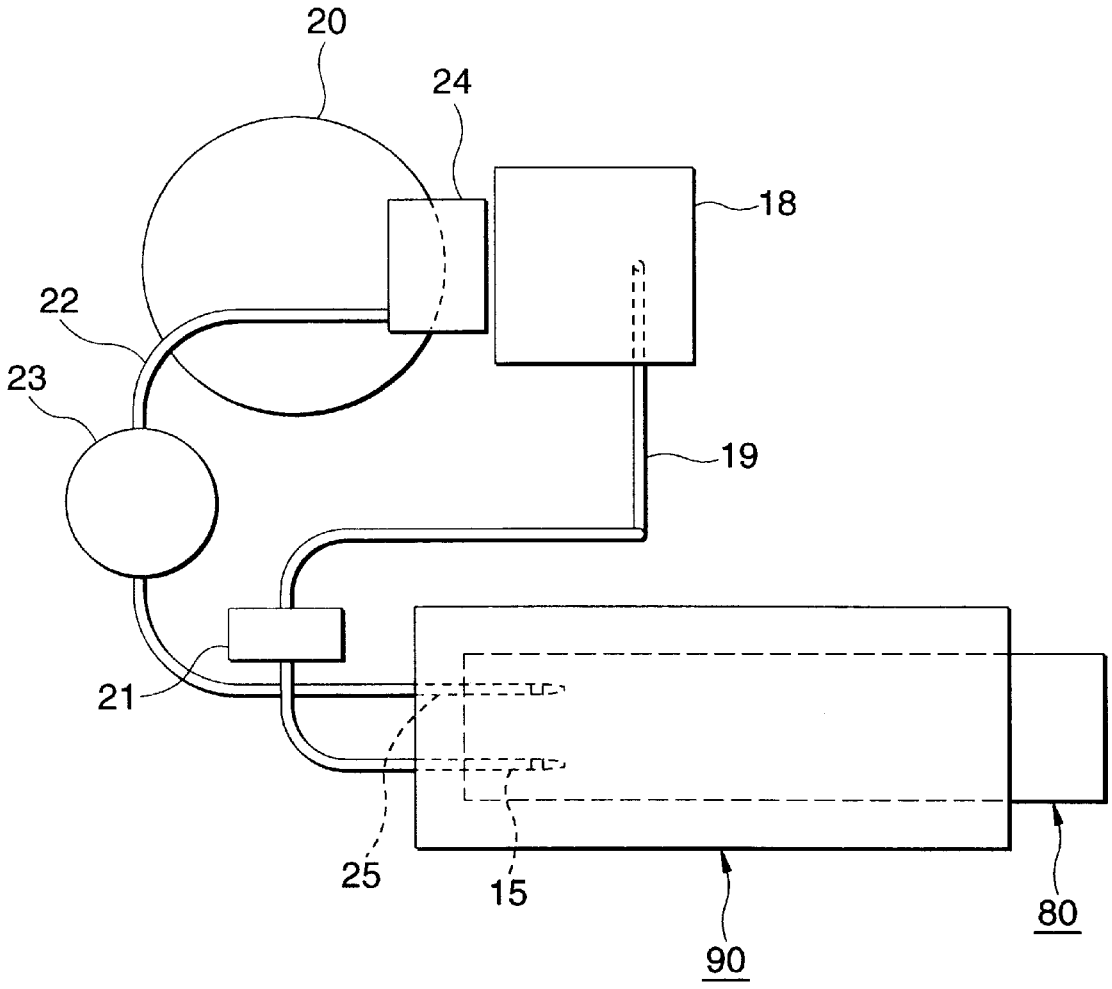
FIG. 12 is a diagrammatic view schematically illustrating an ink flow passage system for the ink jet recording apparatus.

FIG. 12 is a diagram schematically showing an overall ink passage (ink flow) system of an ink jet printing apparatus into which an ink cartridge embodying the present invention is incorporated. An ink cartridge 80 is held by a holder 90. Ink is led out of an ink bag 1 contained in the holder 90, by way of an ink supplying needle 15. A filter 21 is connected to the output of the ink supplying needle 15. The filter 21 filters out dust and other foreign materials from the supplied ink. The output of the filter 21 is connected to an ink supplying tube 19.

The ink supplying tube 19 supplies ink to a print head 18 held by a carriage, not shown. The print head 18 is reciprocatively moved in the lengthwise direction of a platen 20 while being held by the carriage. The print head 18 prints on a sheet of paper, not shown, placed on the platen 20. A combination of a cap 24 and a pump 23 are provided for maintaining good quality print by the print head 18. The cap/pump combination performs the cleaning (wiping) of the ink jet nozzles of the print head 18 and the sucking of waste ink. The cap 24 and the pump 23 are interconnected by a waste ink tube 22. Waste ink is sucked by the pump 23 through the waste ink tube 22, and supplied to a waste ink collecting portion (absorbing member 100) to be described later, contained in the ink cartridge 80, by way of a waste ink needle 25.

Figure 9:
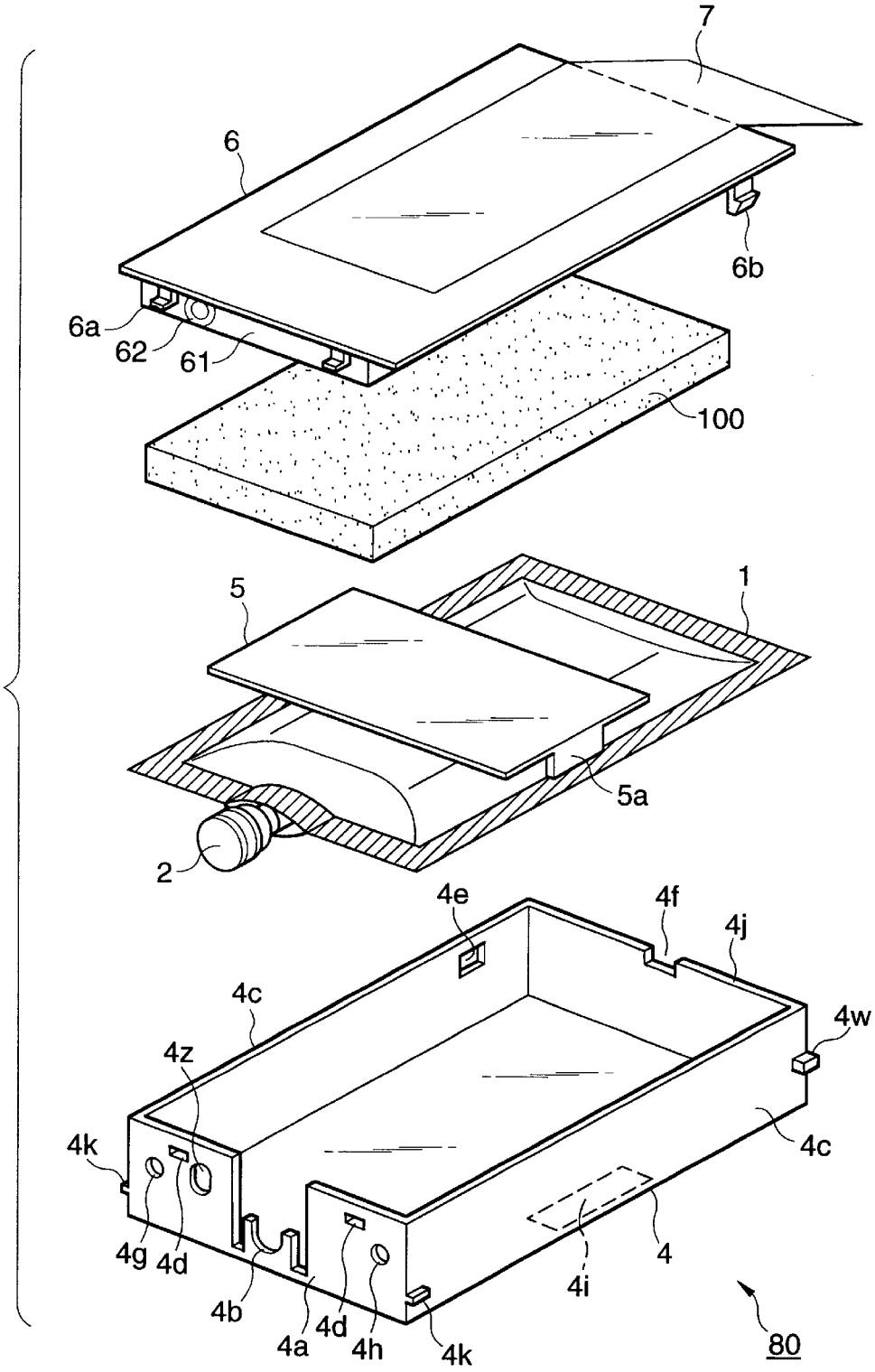
FIG. 9 is an exploded view perspective of another embodiment of an ink cartridge for an ink jet type recording apparatus constructed in accordance with the present invention, particularly illustrating the structure of the ink cartridge in a disassembled state.
Figure 10:
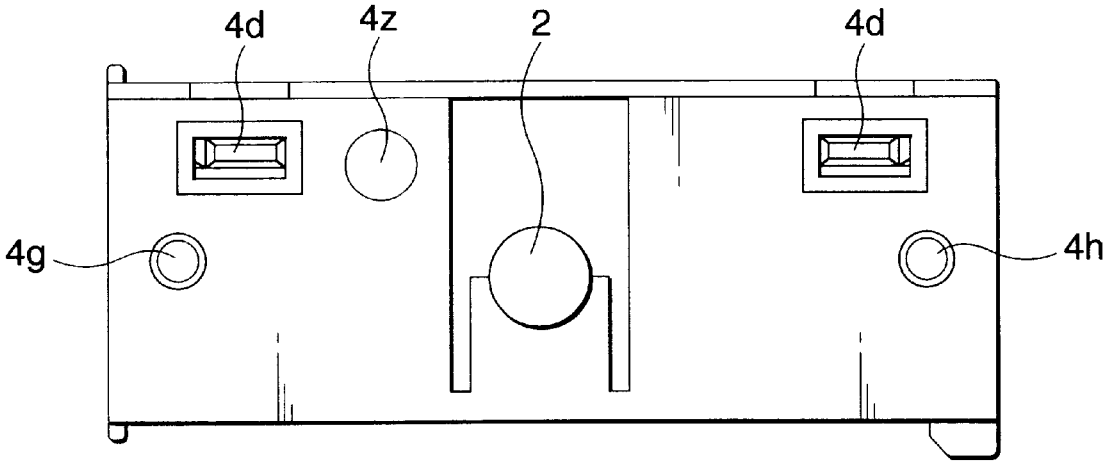
FIG. 10 is a plan view showing the side of the ink cartridge, which has ink takeout ports formed therein.

FIG. 9 is an exploded view perspective of an ink cartridge according to the present embodiment. FIG. 10 is a plan view showing the side of the ink cartridge, which has ink takeout ports formed therein. In those figures, like or equivalent portions are designated by like reference numerals used in FIG. 1.

A rectangular wall 61 is provided on the reverse side of a cover 6. An absorbing member 100 made of pulp is mounted on the inner side of the wall 61. The mounted absorbing member 100 forms the waste ink collecting portion, referred to above, within the ink cartridge 80. The wall 61 is provided with an inlet rubber 62 into which the waste ink needle 25, to be described in detail further below, is inserted. A hole 4*z* is formed in a front plate 4*a* of the ink cartridge 80.

Figure 11:
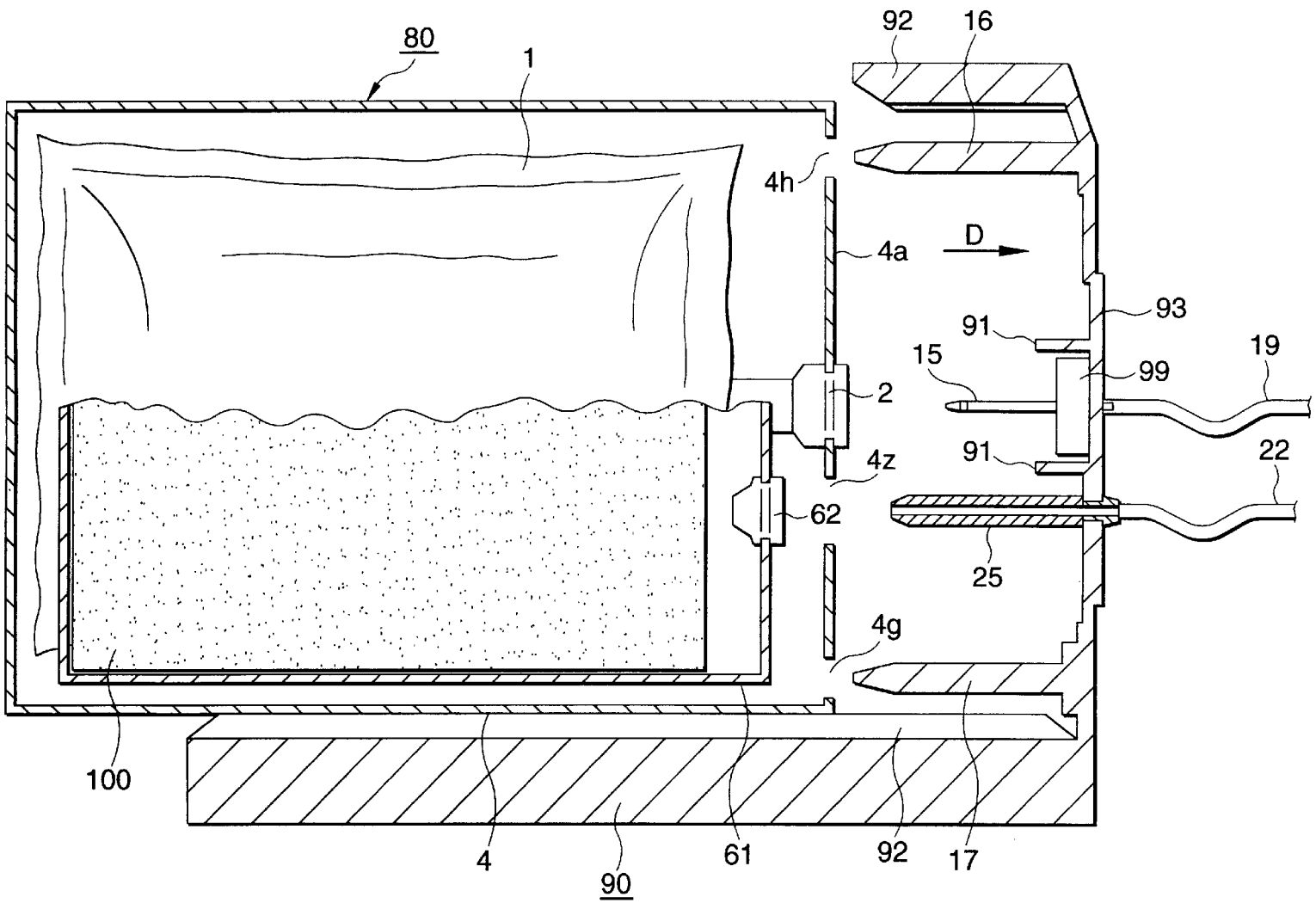
FIG. 11 is a cross sectional view showing the ink cartridge and the ink cartridge holder.

FIG. 11 illustrates how the ink cartridge 11 is attached to the ink jet printing device. FIG. 11 is a cross sectional view showing a structure including the ink cartridge 80 and the holder 90 that holds the ink cartridge 80.

Guide means 92 are provided on the upper and lower sides of the holder 90. The guide means 92 are fixed to the ink jet printing device (not shown), and function to guide the insertion of the ink cartridge 80 and to hold the ink cartridge 80 in place. A bottom wall 93 is provided on the deepest side of the holder 90, while interconnecting the upper and lower guide means 92. A couple of guide shafts 16 and 17, the ink supplying needle 15 made of metal, a base 99 for fixedly supporting the ink supplying needle 15, the waste ink needle 25, and wall 91 for defining the insertion direction of the ink cartridge 80 stand erect on the bottom wall 93. The guide means 92, bottom wall 93, guide shafts 16 and 17, waste ink needle 25, and wall 91 are plastic molded into a one-piece construction. On the reverse side of the bottom wall 93, the ink supplying needle 15 is connected to the ink supplying tube 19, and the waste ink needle 25 is connected to the waste ink tube 22.

The ink cartridge 80 is moved in the direction of an arrow D for its insertion while being guided by the guide means 92. When the ink cartridge is further inserted beyond the position illustrated, the guide shafts 16 and 17, which extend upward from the bottom wall 93, are respectively inserted into a position determining hole 4*h* and a position determining hole 4*g*. As a result, the ink cartridge 80 is vertically and horizontally positioned within the holder 90. The tips of the guide shafts 16 and 17 are tapered so as to the guide shafts to smoothly be inserted into the position determining holes 4*h* and 4*g*. The heights of the guide shafts 16 and 17, ink supplying needle 15 and waste ink needle 25 are selected so that the waste ink needle 25 does not reach the inlet rubber 62. The coupling of the guide shafts 16 and 17 with the position determining holes 4*h* and 4*g* positions the ink cartridge 80 with respect to the ink supplying needle 15 and the waste ink needle 25.

When the ink cartridge 80 further advances, the ink supplying needle 15 breaks through an outlet rubber 3 and the ink outlet piece 2, wherein the outlet rubber 3 is fitted into the forward end part of the ink outlet piece 2 as illustrated in FIG. 3, and reaches the waste ink collecting portion (absorbing member 100) surrounded by the rectangular wall 61 within the ink cartridge 80.

Finally, the front plate 4*a* of the ink cartridge 80 is abutted against the wall 91 that surrounds the base 99, and fixed thereat by locking means, not shown. In this state, the ink bag 1 in the ink cartridge 80 communicates with the print head 18 through the ink supplying tube 19, and the waste ink collecting portion (absorbing member 100) is connected to the waste ink tube 22. The outlet rubber 3 tightly contacts with the side surface of the waste ink needle 25, whereby no ink is leaked out of the waste ink collecting portion (absorbing member 100).

To detach the ink cartridge 80, the locking means is unlocked and the ink cartridge 80 is moved in the direction that is reverse to the direction D. The ink supplying needle 15 and the waste ink needle 25 are pulled out of the outlet rubber 3 and the inlet rubber 62, and then the guide shafts 16 and 17 are disengaged from the position determining holes 4*h* and 4*g*. The ink cartridge 80 is guided by the guide shafts 16 and 17, and moves along and parallel to the ink supplying needle 15 and the waste ink needle 25. Therefore, in detaching the ink cartridge 80, an desired vertical force is prevented from being exerted on the ink supplying needle 15 and waste ink needle 25.

In the present embodiment, the waste ink needle 25 is made of plastic since it and the holder 90 are plastic molded into a one-piece construction. Alternatively, the waste ink needle 25, like the ink supplying needle 15, may be made of metallic material.

While the present invention has been described above with respect to preferred embodiments, various changes and modifications may be made without departure from the scope of the present invention as defined by the appended claims.

What is claimed is:

1. An ink cartridge assembly for an ink jet recording apparatus, comprising:

a cartridge containing a supply of ink and having a front plate, said front plate including at least one hole and an ink outlet piece; and a cartridge holder for mounting said cartridge, said cartridge holder having at least one guiding shaft and an ink feeding needle projecting from an inner end of said cartridge holder, said guiding shaft being positioned in said at least one hole of said cartridge and for guiding and properly locating said cartridge relative to said cartridge holder in both an upward/downward direction and a leftward/rightward direction, the longitudinal axis of said guiding shaft defining a thrust direction, said ink feeding needle piercing said ink outlet piece and projecting into an interior of said cartridge when said cartridge is mounted in said cartridge holder;

wherein said ink feeding needle is disposed slightly behind said guiding shaft in said thrust direction so that said ink feeding needle is positioned in contact with said ink outlet piece when said cartridge is properly positioned in said cartridge holder by said hole and said guiding shaft.

2. An ink cartridge assembly as claimed in claim 1, further comprising an ink bag disposed in said cartridge in communication with said ink outlet piece, and an exhaust ink absorbing member, disposed with said ink bag in said cartridge, for absorbing exhaust ink;

wherein said cartridge holder includes an exhaust ink take-in piece disposed at said inner end of said cartridge holder for directing the exhaust ink into said cartridge.

3. An ink cartridge assembly as claimed in claim 2, wherein said guiding shaft disposed in said inner end of said cartridge holder, said ink feeding needle and said exhaust ink take-in piece have different lengths from each other in the thrust direction.

4. An ink cartridge assembly as claimed in claim 3, wherein a tip of said guiding shaft is tapered.

5. An ink cartridge assembly as claimed in claim 2, wherein said cartridge holder, said guiding shaft and said ink exhaust take-in piece are molded into a one-piece construction.

6. An ink cartridge assembly as claimed in claim 1, wherein said cartridge holder includes two guides, respectively provided on upper and lower sides of said cartridge holder, for guiding said ink cartridge into said cartridge holder.

7. An ink cartridge assembly as claimed in claim 6, wherein said cartridge holder, said guiding shaft and said guides are molded into a one-piece construction.

* * * * *